United States Patent [19]

Miyake et al.

[11] Patent Number: 4,669,900

[45] Date of Patent: Jun. 2, 1987

[54] HOME POSITION SETTING SYSTEM FOR A PRINT CARRIAGE

[75] Inventors: Tomohisa Miyake, Kanagawa; Tsutomu Kataigi, Saitama; Toshinobu Shinozuka, Tokyo, all of Japan

[73] Assignee: Tokyo Juki Industrial Co., LTD, Tokyo, Japan

[21] Appl. No.: 775,426

[22] Filed: Sep. 12, 1985

[30] Foreign Application Priority Data

Sep. 20, 1984 [JP] Japan ..... 59-197253

[51] Int. Cl.[4] ..... B41J 19/30

[52] U.S. Cl. ..... 400/322; 400/320; 400/903; 318/640; 318/685

[58] Field of Search ..... 400/320, 322, 328, 902, 400/903; 318/638, 640, 652, 685

[56] References Cited

U.S. PATENT DOCUMENTS

| | | | |
|---|---|---|---|
| 3,869,983 | 3/1975 | Garber et al. | 101/137 |
| 4,044,882 | 8/1977 | Weinke et al. | 400/320 |
| 4,185,930 | 1/1980 | Umeda et al. | 400/320 |
| 4,311,399 | 1/1982 | Wegryn et al. | 400/903 |
| 4,362,980 | 12/1982 | Itzkowitz | 318/685 |
| 4,403,180 | 9/1983 | Tsuboshima | 318/640 |

FOREIGN PATENT DOCUMENTS

| | | | |
|---|---|---|---|
| 56-60286 | 5/1981 | Japan | 400/320 |
| 57-199678 | 12/1982 | Japan | 400/320 |
| 8681 | 1/1983 | Japan | 400/903 |
| 19182 | 1/1984 | Japan | 400/322 |

OTHER PUBLICATIONS

G. Goldrian, "Electronic Slip Compensation for Wire Rope Drives of Printer Carriages", *IBM Tech. Disc. Bull.*; vol. 24, No. 5, p. 2658, Oct. 1981.

*Primary Examiner*—Edgar S. Burr
*Assistant Examiner*—David A. Wiecking
*Attorney, Agent, or Firm*—Tarolli, Sundheim & Covell

[57] ABSTRACT

The printer is characterized by construction adapted to detect the offsetting of the carriage from its intended position by signals of a sensor which detects the carriage offset at a first position spaced by a predetermined distance in the opposite direction of the home position of the carriage and at a second position which is the home position.

5 Claims, 6 Drawing Figures

21
MASTER CPU
23
28
PORT
INTERFACE
33
51
PULSE GENERATOR
29
PORT
35
34
PANEL
31
ROM
22
32
RAM
38
37
24
SLAVE CPU
DRIVE
40
39
DRIVE
43
6
25
SLAVE CPU
DRIVE
45
44
DRIVE
47
46
RECEPTION
26
49
48
SLAVE CPU
DRIVE
50
11
RECEPTION
C

HOME POSITION SETTING SYSTEM FOR A PRINT CARRIAGE

BACKGROUND OF THE INVENTION

The present invention relates to an open-controlled serial printer and, more particularly, to detection of offsetting of the carriage from its intended position.

A conventional printer of this kind usually has the construction comprising, as shown in FIG. 1, a platen 1, a carriage 2 for setting the printing position in the line direction, a belt 3 for driving the carriage 2, a daisy wheel 5 having types 5*a*, 5*b*, 5*c* . . . formed at ends of respective spokes, a daisy wheel motor 6 for driving the daisy wheel 5, and a hammer 7 applying a printing impact to the types.

A sensor device 11 comprising a light emitting element 9 and a light receiving element 10 is secured to the carriage 2. The sensor device 11 is constructed so as to move with the carriage 2 as one body. The printer of FIG. 1 further comprises a sensor bar 12 secured to the position at which the left margin is zero and is so constructed that the light path of the sensor device 11 is obstructed by the sensor bar 12 when the carriage 2 takes the position at which the left margin is zero or the home position. In FIG. 1, the sensor bar 12 is shown at a position difference from the position at which it should be in actual construction.

In the printer of the construction shown in FIG. 1, the carriage 2 is driven by the carriage motor to determine the printing position in the line direction, the daisy wheel 5 is rotated by the daisy wheel motor 6 to select the printing type, and, thereafter, the printing type at the end of the spoke is given an impact by the hammer 7 from the reverse side toward the platen 1 to print on a printing paper 13.

Heretofore, in the printer of this type, in order to detect whether the accurate printing position, that is the position of the carriage 2, is selected or not (hereinafter called out of step sensing), the printer is so adjusted that the carriage 2 is returned to the home position upon initializing the printer and the sensor bar 12 obstructs the light path of the sensor device 11 (dark check). After the printer has been initialized, if the left margin is set to zero, the dark check is performed to detect carriage offset when the carriage return order is executed or each time form feed (F.F. operation) is carried out.

However, the conventional printer of the construction described above has a disadvantage that accurate out of step sensing of unintended carriage offset is impossible in the case where the carriage 2 is stepped out or offset toward left.

This disadvantage will be described with reference to FIGS. 1 and 2 in which the same component parts are denoted by the same reference numerals. The sensor bar 12 is secured in the proximity to a frame 15 to minimize dead zone. If dark check is carried out in the state in which the carriage is out of step by $X_0$ toward right, a carriage motor is applied with a number of steps corresponding to a theoretical distance $\alpha$ required to return the carriage 2 from the print position, according to the total number of steps of the motor, to a home position $P_1$. As the result, the carriage 2, that is the sensor device 11, returns to a point R which is spaced from the home position $P_1$ to right by $X_0$. If dark check is carried out in this state, the light path of the sensor device 11 is not obstructed by the sensor bar 12 and applies a light signal, whereby the out of step is detected.

On the other hand, if the dark check is carried out in the state in which the carriage 2 is out of step or offset toward left by $X_0$, the carriage motor is applied with a number of steps corresponding to the distance $\alpha$ to thereby, theoretically, return the carriage 2, that is the sensor device 11, to a point L which is spaced from the home positon $P_1$ to left by $X_0$.

In fact, however, in the case where the carriage 2 is out of step or offset toward left, the carriage 2 is brought in contact with the frame 15 and, accordingly, the carriage 2, that is the sensor device 11, stops at a position M at which the carriage 2 is in contact with the frame 15. In this state, therefore, despite the offset of the carriage 2, a dark signal is applied from the sensor device 11, to thereby decide that there is no offset. As described above, the conventional printer of this type has a disadvantage that accurate out of step detection is impossible with it.

SUMMARY OF THE INVENTION

It is an object of the present invention to overcome the disadvantage of the conventional printer and, more particularly, to provide a printer adapted to accurately detect out of step or offset of the carriage in either of right and left direction and to accurately print.

The printer according to the present invention is characterized by the construction adapted to detect the out of step of the carriage by signals of the sensor which detects the out of step at a first or sensing position spaced by a predetermined distance in the opposite direction of the home position of the carriage and at a second position which is the home position.

Accordingly, the printer according to the present invention provides the effect that, even when the carriage is out of step or offset toward the home position, the out of step is accurately detected by the sensor signal at the first or sensing position, to thereby make accurate printing possible.

BRIEF DESCRIPTION OF THE DRAWINGS

The invention will be better understood from the following description taken in connection with the accompanying drawings in which.

DESCRIPTION OF THE PREFERRED EMBODIMENTS

Figure 3:
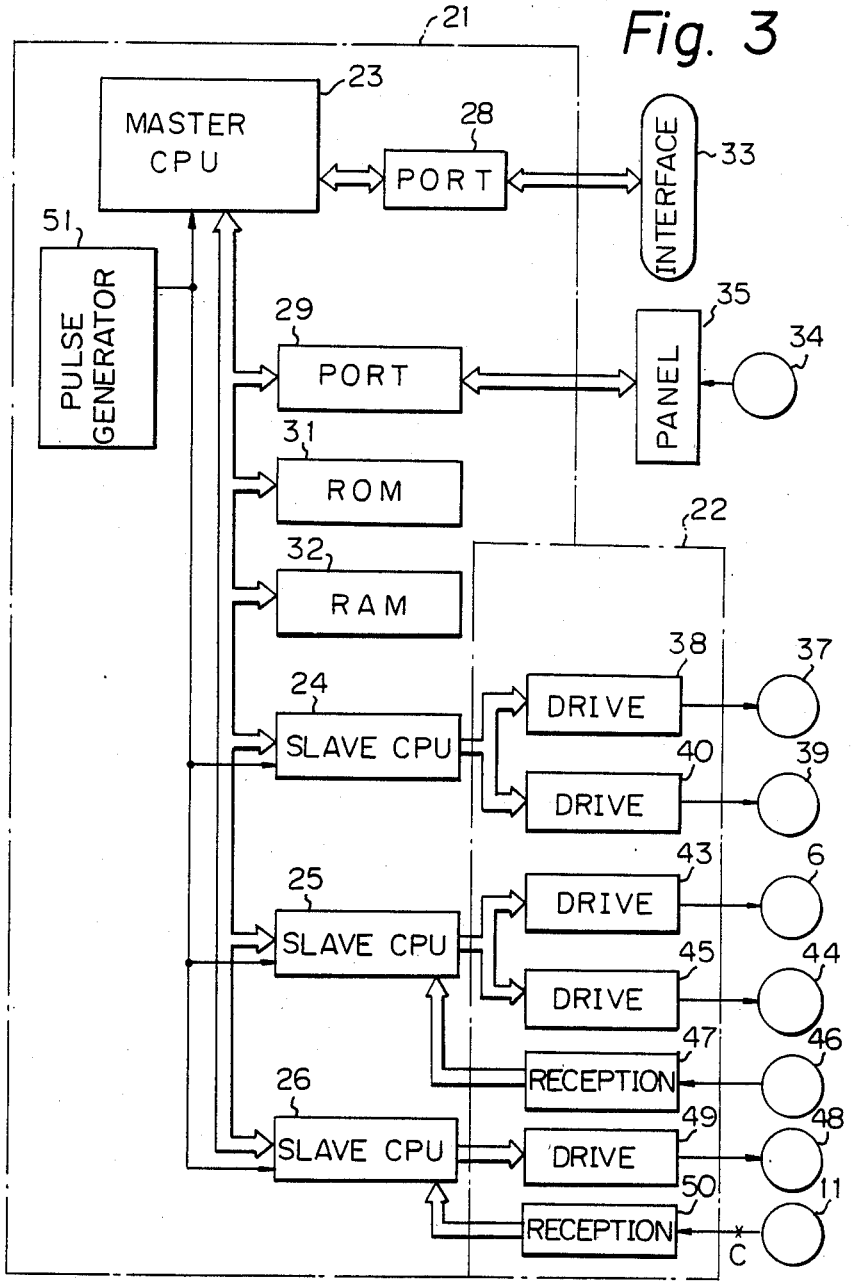
FIG. 3 is a block diagram of essential portions of an embodiment of the present invention.

An embodiment of the printer according to the present invention will now be described with reference to the drawings, in which FIG. 3 is a block diagram of essential portions of the embodiment of the present invention. The embodiment shown in FIG. 3 comprises two major units, that is, a control unit 21 and drive units 22 of respective motors. Connected to a master CPU 23 are slave CPU's 24, 25 and 26, ports 28 and 29, a ROM 31 storing a control program of the printer, and a RAM 32 storing data, respectively. An input device (not shown) for printing character information and others is connected to the port 28 through an interface circuit 33. A control panel 35 provided with various function switches including a pause switch 34 is connected to the port 29.

Figure 1:
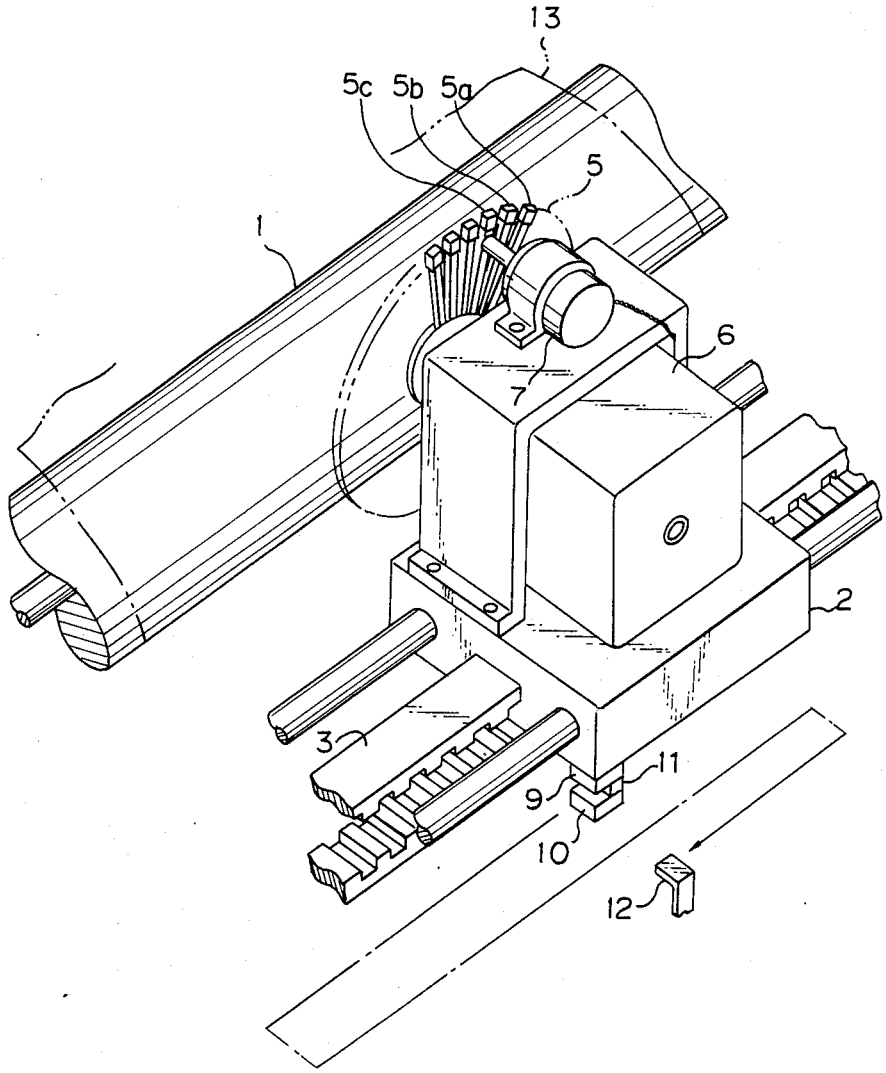
Fig. 1 (PRIOR ART)
FIG. 1 is a perspective view of essential portions of a prior art printer.

Connected to the slave CPU 24 are a drive circuit 38 for driving a paper feed motor 37 and a drive circuit 40 for driving an ink ribbon feed motor 39, respectively. Connected to the slave CPU 25 are a drive circuit 43 for driving the daisy wheel motor 6 rotating the daisy wheel 5 (FIG. 1) and a drive circuit 45 for driving a hammer magnet 44. A reception circuit 47 receiving a sensor signal of a sensor device 46 detecting the home position of the daisy wheel 5 is connected to the slave CPU 25. Further, connected to the slave CPU 26 are a drive circuit 49 for driving a carriage motor 48 moving the carriage 2 and a reception circuit 50 receiving a sensor signal of the sensor device 11, respectively.

Designated by reference numeral 51 in FIG. 3 is a pulse generator for generating a reference clock signal of 6 $MH_Z$.

Figure 2:
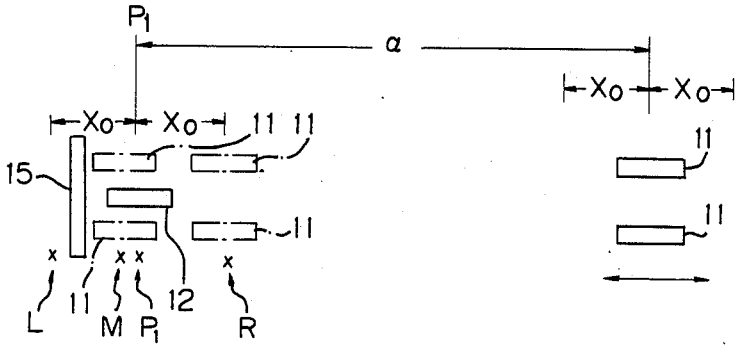
Fig. 2 (PRIOR ART)
FIG. 2 is a schematic plan view illustrating detection of out of step or offset in the prior art printer.
Figure 5:
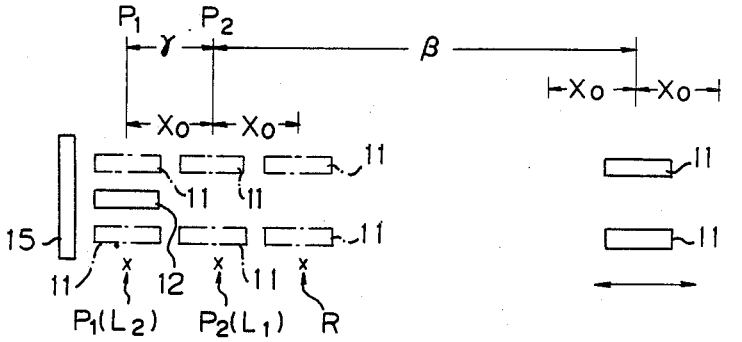
FIG. 5 is a schematic plan view illustrating the operation of an embodiment of the present invention.
Figure 4A:
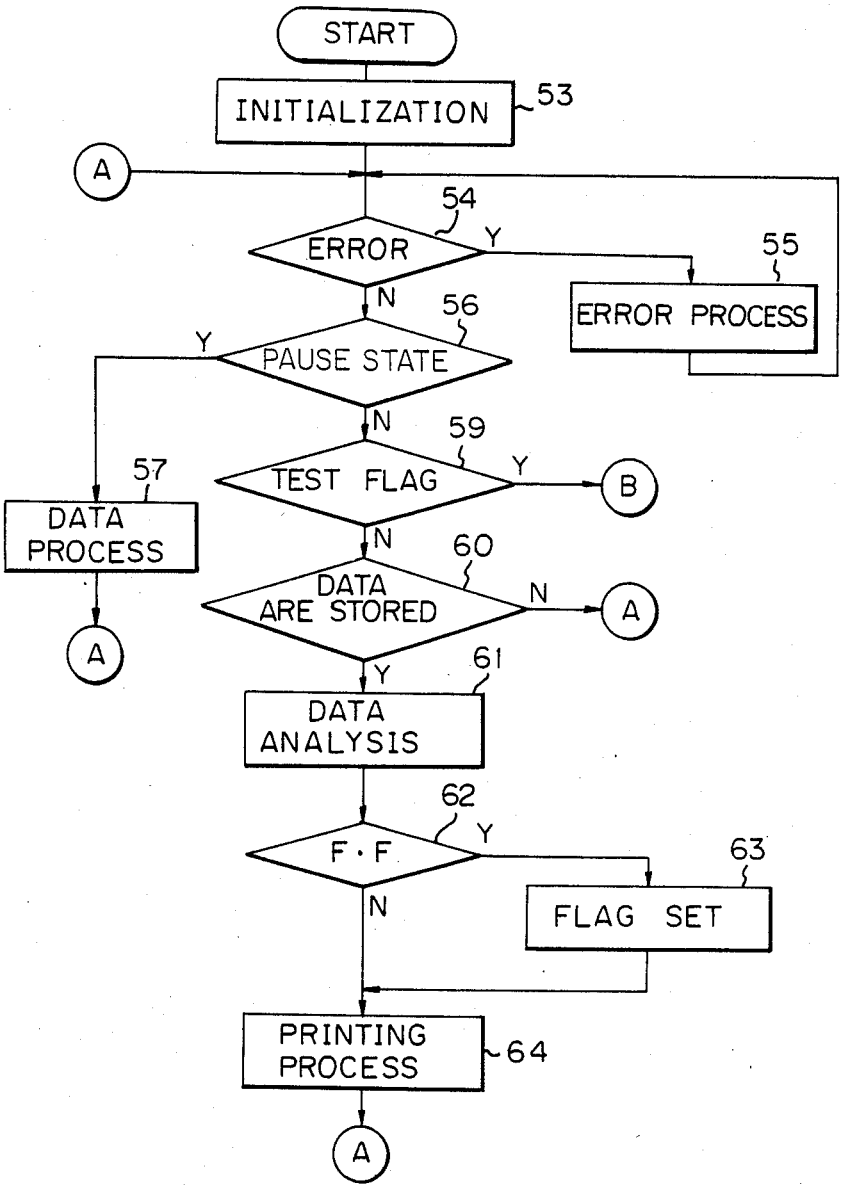
FIGS. 4*a* and 4*b* are flow charts of an embodiment of the present invention.
Figure 4B:
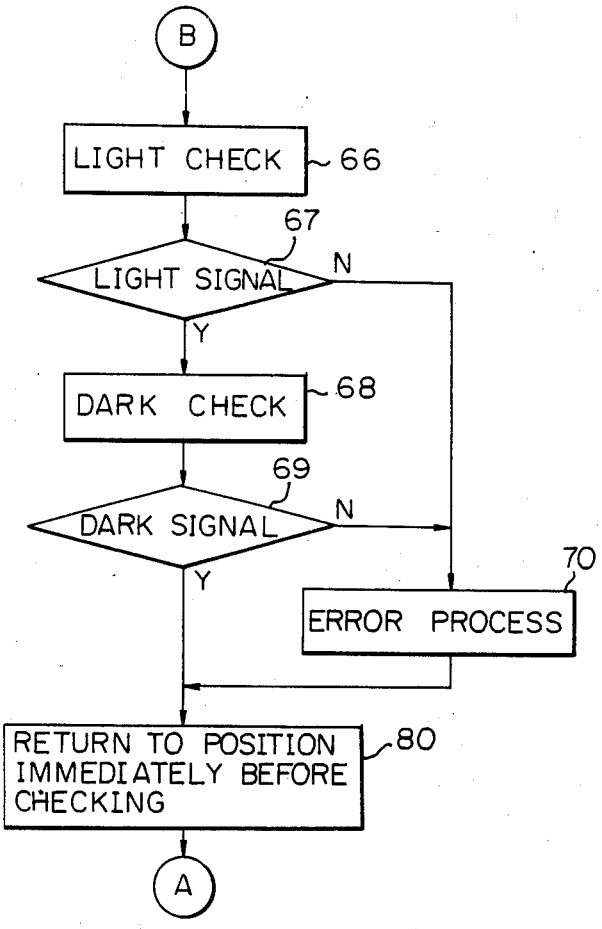

FIGS. 4*a* and 4*b* are flow charts of the embodiment of the present invention and FIG. 5 is a schematic plan view illustrating operation of the embodiment of the present invention. Throughout FIGS. 2 and 5, the same poritons are denoted by the same reference numerals.

Characteristic operations of the embodiment of the present invention having the construction described above will now be explained. The master CPU 23 initializes the printer (block 53 of FIG. 4*a*) by a general initializing operation in accordance with a program stored in the ROM 31 (the program according to the flow charts of FIGS. 4*a* and 4*b*). That is, the master CPU 23 applies the initializing data to each of the slave CPU's 24, 25 and 26 which, in turn, initialize the respective means according to the data.

At this time, the slave CPU 26 returns the carriage 2 toward the home position with the carriage motor 48. The carriage 2 is to be initialized to the position at which a dark signal of the home position is detected. If there is any mechanical disorder of the carriage 2 (such as inability to move) in the initializing operation and the dark signal is not detected, it is detected as an error and this error is processed by a general initializing operation (blocks 54 and 55 of FIG. 4*a*). Since this operation is not a characteristic of this invention, detailed explanation is omitted.

In the case when the pause switch 34 stopping the print is actuated by the operator to bring the print into a pause state (block 56 of FIG. 4*a*), F.F. (Form Feed) input and L.F. (Line Feed) input applied from the control panel 35 through the port 29 are processed (block 57 of FIG. 4*a*). If there is an error during the processing operation, this error is processed by a general operation (blocks 54 and 55 of FIG. 4*a*).

In the case when the printer is not in the pause state and the test flag is not set, and printing character information are stored in the RAM 32 from the input device (not shown) through the interface circuit 33 and the port 28, data analysis is continued (blocks 56, 59, 60 and 61 of FIG. 4*a*) and printing process is performed (block 64 of FIG. 4*a*).

If F.F. information is detected during the data analysis (block 62 of FIG. 4*a*), the test flag is set (block 63 of FIG. 4*a*) and F.F. process is performed (block 64 of FIG. 4*a*).

The test flag is detected in the block 59 of FIG. 4*a* and, thereafter, the characteristic out of step or carriage offset detection detection according to the present invention is performed. In the out of step detecting mechanism of the embodiment of the present invention, as shown in FIG. 5, a light check or sensing position $P_2$, use provided at which a light check is performed to determine that the light path of the sensor device 11 is not obstructed by the sensor bar 12. The sensing position $P_2$ is set with a distance equivalent to $\gamma=\frac{1}{2}$ column ($\frac{1}{2}$ distance between characteristics) toward right from the home position $P_1$ of the carriage. In FIG. 5, $\gamma=X_0$.

In the case when the carriage 2 happens to be out of step or offset toward right by $X_0$, if the test flag is detected (block 59 of FIG. 4*a*), light check is performed first (block 66 of FIG. 4*b*). That is, the master CPU 23 transmits the light check data to the slave CPU 26.

The slave CPU 26 then provides the carriage motor 48 with the number of steps corresponding to a distance $\beta$ which is theoretically required to return the carriage 2 from the present position indicated by the master CPU 23. This theoretical distance is in accordance with the total number of steps of the motor required to move the carriage 2 to the light check or sensing position $P_2$. By this, the carriage 2, that is the sensor device 11, which is out of step, is actually returned to the first carriage locating position R which is spaced from the light check position toward right by $X_0$. At this time, the sensor signal C (FIG. 3) from the sensor device 11 is a light signal (first sensor signal) and the result of the light check is determined to be in order (block 67 of FIG. 4*b*), then the dark check is performed (block 68 of FIG. 4*b*).

That is, the master CPU 23 transmits the dark check data to the slave CPU 26. By this, the slave CPU 26 provides the carriage motor 48 with the number of steps required to move the carriage 2 to left by $\gamma$ (in this embodiment, $\frac{1}{2}$ column, that is, one-half of the distance between centers of adjacent print positions). By this, the carriage 2, that is the sensor device 11, is returned to a second carriage locating position ($L_1$) which is spaced from the point R by $\gamma$.

Here, since $X_0=\gamma$ in this embodiment as shown in FIG. 5, the point ($L_1$) or second carriage locating position coincides with the light check or sensing position $P_2$. At this point ($L_1$), the sensor signal C is a light signal, and a dark check is judged as an error (block 69 of FIG. 4*b*), whereby the out of step or offset is detected. When the out of step is detected, an error porcess is performed (block 70 of FIG. 4*b*).

Now, in the case where the carriage 2 is out of step or offset to left by $X_0$, if the test flag is detected, the light check is performed (block 59 of FIG. 4*a* and block 66 of FIG. 4*b*). That is, the master CPU 23 transmits the light check data to the slave CPU 26. The slave CPU 26 transmits to the carriage motor 48 the number of steps corresponding to the distance $\beta$ which is theoretically required to return the carriage 2 from the present print position to the sensing position $P_2$. The theoretical distance represented by data in the master CPU 23 is in accordance with the total number of steps of the motor up to the present time. As a result, the carriage 2, that is the sensor device 11, which is out of step, is returned to a first carriage locating position ($L_2$) which, due to the out of step condition of the carriage 2, corresponds to the home position. When the carriage 2 is at the first carriage locating position $L_2$ it is spaced from the light check position $P_2$ to left by $X_0$.

Here, in this embodiment, since $X_0=\gamma$ as shown in FIG. 5, the point ($L_2$) coincides with the home position $P_1$. At this point ($L_2$), the sensor signal C is a dark signal (a second sensor signal), and a light check is judged as an error, whereby the out of step is detected (block 67 of FIG. 4*b*). When the out of step is detected, an error process is performed (block 70 of FIG. 4*b*).

If the carriage 2 is not out of step, both the light check and the dark check will naturally be judged to be in order.

When the carriage 2 is not out of step or its out of step has been corrected, the carriage 2 is returned to the position immediately before the checking (block 80 of FIG. 4*b*).

While the light position has been explained in the foregoing embodiment as $\gamma=\frac{1}{2}$ column ($\frac{1}{2}$ character distance), it is to be understood that the light position in the present invention may be different than $\frac{1}{2}$ column but may be any value equal to or larger than one step of the carriage motor to provides the same operation and effects.

Further, the sensor device in the embodiment of the present invention is not limited to the optical sensor but may be composed of a contact switch or a logic circuit, or may be switches disposed at the positions $P_1$ and $P_2$, respectively.

While we have shown and described a specific embodiment of the invention, it will be understood by those skilled in the art that this embodiment is merely for the purpose of illustration and description and that various other forms may be devised within the scope of the invention, as defined in the appended claims.

What is claimed is:

1. An out of step sensing apparatus for a printer comprising a carriage for setting the printing position in the line direction, a stepping motor for moving said carriage, a circuit for detecting the present position of the carriage according to the number of steps of said stepping motor, and an out of step sensing signal generating circuit having at least a portion thereof movable with said carriage as one body and another portion thereof fixed at a home position for said carriage, said out of step sensing apparatus for printing being characterized by further comprising:

a sensing position spaced by at least one step of said stepping motor from said home position in a direction away from said home position for sensing an out of step of said carraige in a direction toward the home position; and a control circuit comprising means for returning said carriage in a direction toward said sensing position by a first amount of distance corresponding to a distance between said sensing position and a present carriage position according to the output of said circuit for detecting the present position of the carriage, said control circuit also comprising means for sensing said out of step of said carriage in a direction toward said home position by an output signal from said out of step sensing signal generating circuit after said carriage is moved by said first amount of distance, said control circuit comprising means responsive to said out of step of said carriage not being sensed for returning said carriage toward said home position by a second amount of distance corresponding to a distance between said sensing position and said home position, and for sensing an out of step of said carriage in a direction opposite to said home position by an output signal from said out of step sensing signal generating circuit when said carriage is moved by said second amount of distance.

2. An apparatus as set forth in claim 1, in which said out of step sensing signal generating circuit includes a movable pair of opposed light emitting element and light receiving element and a fixed sensor bar.

3. An apparatus for use in printing on sheet material, said apparatus comprising longitudinally extending platen means for supporting the sheet material, printer means for printing on the sheet material while the sheet material is supported by said platen means, carriage means connected with said printer means and movable along said platen means from a home position adjacent to one end of said platen means through a sensing position spaced a predetermined distance from said home position to any one of a plurality of print positions, carriage drive means for moving said carriage means between the home, sensing and print positions, first detector means for detecting relative amounts of movement of said carriage drive means, control means for effecting operation of said carriage drive means to move said carriage means from one of the print positions toward the home position through a distance as determined by said first detector means between the one of the print positions and the sensing position to a first carriage locating position, second detector means for detecting whether or not said carriage means is in the home position after movement of said carriage means through the theoretical distance between the one print position and the sensing position to the first carriage locating position, said control means including means for providing an error signal in response to said second detector means detecting that said carriage means is in the home position after having moved from the one print position through a distance as determined by said first detector means between the one print position and the sensing position to the first carriage locating position, said control means further including means for effecting operation of said carriage drive means to move said carriage means from the first carriage locating position through a distance corresponding to the predetermined distance between the sensing position and the home position to a second carriage locating position, said second detector means being operable to detect whether or not said carriage means is in the home position after movement of said carriage means to the second carriage locating position, said control means further including means for providing an error signal in response to said second detector means detecting that said carriage means is not in the home position after having moved from the first carriage locating position to the second carriage locating position.

4. An apparatus as set forth in claim 3 wherein the predetermined distance between the home position and sensing position is one-half of the distance between the centers of two of said adjacent print positions, said control means being operable to effect operation of said carriage drive means through a distance equal to one-half the distance between the centers of adjacent print positions when moving said carriage means from the first carriage locating position to the second carriage locating position.

5. An apparatus as set forth in claim 3 wherein said second detector means includes light emitting and receiving elements.

* * * * *